US007291100B2

(12) United States Patent
Dodge et al.

(10) Patent No.: US 7,291,100 B2
(45) Date of Patent: Nov. 6, 2007

(54) EXERCISE EQUIPMENT RESISTANCE UNIT

(75) Inventors: David J. Dodge, Williston, VT (US); Robert Walsh, Matawan, NJ (US); William C. Doble, Essex Junction, VT (US)

(73) Assignee: Alliance Design & Design Development Group, Inc., Essex Junction, VT (US)

( * ) Notice: Subject to any disclaimer, the term of this patent is extended or adjusted under 35 U.S.C. 154(b) by 588 days.

(21) Appl. No.: 10/370,975

(22) Filed: Feb. 20, 2003

(65) Prior Publication Data

US 2004/0166999 A1 Aug. 26, 2004

(51) Int. Cl.
*A63B 21/00* (2006.01)

(52) U.S. Cl. ..... 482/121; 482/122; 482/126

(58) Field of Classification Search ..... 602/32, 602/124.6, 124.25, 6; 482/121, 142, 126, 482/124, 140

See application file for complete search history.

(56) References Cited

U.S. PATENT DOCUMENTS 2,035,010 A * 3/1936 Rawlings ..... 601/23
3,638,941 A 2/1972 Kulkens
3,647,209 A 3/1972 LaLanne
3,834,696 A 9/1974 Spector
3,944,221 A 3/1976 Berkstad et al.
3,955,655 A 5/1976 Pornin
4,072,309 A 2/1978 Wilson
4,148,479 A 4/1979 Spector
4,333,645 A 6/1982 Wu
4,620,704 A 11/1986 Shifferaw
4,725,057 A 2/1988 Shifferaw
5,100,130 A * 3/1992 Shoebrooks ..... 482/121
5,603,678 A 2/1997 Wilson
6,443,139 B1 * 9/2002 McPherson ..... 124/25.6
6,634,999 B2 * 10/2003 Herbst ..... 482/142

* cited by examiner

*Primary Examiner*—Jerome W. Donnelly

(57) ABSTRACT

A sports apparatus provides a variable resistance to a user. A resilient panel can be adjusted for custom resistance. The resilient panel is provided with pulleys and cables arranged to deflect the panel when a user provides a force on the cable. The user can transmit force to the resilient panel by attaching a suitable exercise implement to the cable. The resilient can also be arranged as required by the type of exercise and for convenience.

7 Claims, 18 Drawing Sheets

EXERCISE EQUIPMENT RESISTANCE UNIT

STATEMENT REGARDING FEDERALLY SPONSORED RESEARCH OR DEVELOPMENT

Not Applicable

BACKGROUND OF THE INVENTION

1. Field of the Invention

The invention relates to a means of achieving differing amounts of weight-like resistance in exercise equipment.

2. Discussion of Related Art

Over the years, many people have sought exercise equipment for strengthening muscles for sports and general fitness; rehabilitating injuries; reducing body fat; and enhancing cardiovascular fitness. Free weights, such as barbells and dumbbells, allow the user to lift weights that are not constrained in any type of frame or machine. Accordingly, free weights have been the most common method of achieving resistance due to their simplicity, consistency and low cost. Free weights are usually formed from metal and have no moving parts, liquids, gases or other substances. The amount of resistance provided by a dead weight is consistent because the mass that the user has to lift is unchanged throughout the exercise. This consistency is an advantage for many users. The simple manner and materials used in forming a dead free weight permits it to be relatively low cost.

However, free weights have several disadvantages. Because a free weight consists simply of the mass of the weight itself, the free weight requires heavy materials to be used in the construction of the equipment. If any additional equipment is required to support the free weight, such as a bench press bench, the additional equipment must be of sturdy construction in order to support the mass of the free weights. This results in an increase in the equipment's weight and bulk; as well as manufacturing, handling and shipping costs; lack of portability; and limitations where the equipment can be located for use. Additionally, the movement of free weights creates a potentially dangerous environment where the weights can fall or accidentally be dropped on to the user or a bystander.

Early exercise equipment typically took the form of a simple bench onto which the user could lay on his back and lift a barbell type weight from a cradle-like support. Users of such weight benches found they were able to better control the weight and concentrate exercises on specific muscle groups. The weight bench concept has evolved and improved so as to control the direction of resistance to better isolate the workout of certain muscle groups. Such equipment provides a constraint for the motion of the weight, reducing the need for a bystander to guide the weight through the range of motion in the exercise.

Exercise equipment manufacturers have attempted to use other methods to convert a free weight or other free standing methods of resistance into a useful means of resistance for exercise equipment. Resistance is achieved by providing a mechanical advantage to lower the mass required. Wilson, U.S. Pat. No. 4,072,309 teaches the use of a circular elastic cord to provide resistance. Elastomeric weight straps are disclosed in Wilson, U.S. Pat. No. 5,603,678 as an alternative or complement to the use of dead weight as a resistance device. Shifferaw, in U.S. Pat. No. 4,620,704 and continued in U.S. Pat. No. 4,725,057, teaches the use of resilient rods as a means of providing resistance. Numerous devices utilize resistance methods based on hydraulic systems such as those described in Spector, U.S. Pat. No. 3,834,696 and U.S. Pat. No. 4,148,479 or other fluid systems such as Pornin, U.S. Pat. No. 3,955,655. Resistance methods based on the use of air cylinders can be found in Berkestad, U.S. Pat. No. 3,944,221 and gas cylinders such as Wu, U.S. Pat. No. 4,333,645. Kulkens, U.S. Pat. No. 3,638,941 describes the use of springs as a resistive device.

Another consideration for the design of exercise machines is the ability to change the level of resistance to suit the particular user and the exercise being performed. When a dead weight method of resistance is used the user must stop the exercise routine to change the amount of weight desired. In the simplest, barbell type system, this requires the user to stop the exercise and physically affix or remove the dead weight on the bar before resuming his workout. Most modern exercise devices that utilize a sliding weight system such as found in LaLanne, U.S. Pat. No. 3,647,209 have a system of cables, pulleys and deadweight to achieve resistance, whereby the movement of pins engages or disengages the desired weights onto the lifting device. However, this type of system also requires that the user stop the exercise and frequently move to a new position to affect the change in weight resistance. Changing the level of resistance in a system using elastomeric weight straps such as Wilson, U.S. Pat. No. 4,072,309 requires the user to also stop the exercise and physically move to a new position to affect the change in weight resistance by changing the elastic band and/or adding or removing auxiliary dead weights. The resilient rod method of resistance as found in Shifferaw, in U.S. Pat. No. 4,620,704 and continued in U.S. Pat. No. 4,725,057 requires the user to also stop the exercise and physically move to a new position to affect the change in weight resistance by changing the number or type of resistance rods that are connected by cable to the exercise apparatus.

BRIEF DESCRIPTION OF THE INVENTION

The invention herein provides a unique method of achieving resistance in weight machines and fitness equipment used in addition to, or in lieu of weights, rubber bands, bows, springs, hydraulics, or other commonly known methods. A resilient panel generates resistance. The resilient panel can allow for the adjustment of its resistance. Advantages of this device include being compact, lightweight and offering the ability to more easily and quickly change the desired level of resistance than is typically found in units using weights, rubber bands, bows or springs. The resilient panel can provide resistance to the user without being restricted by its orientation or gravity. Accordingly, the resilient panel can be used in almost any exercise machine. The resilient panel can also be used within an exercise machine orientated in many different positions. In addition, the device can vary the resistance provided to the user during an exercise, without interrupting the exercise.

DETAILED DESCRIPTION

Figure 1A:
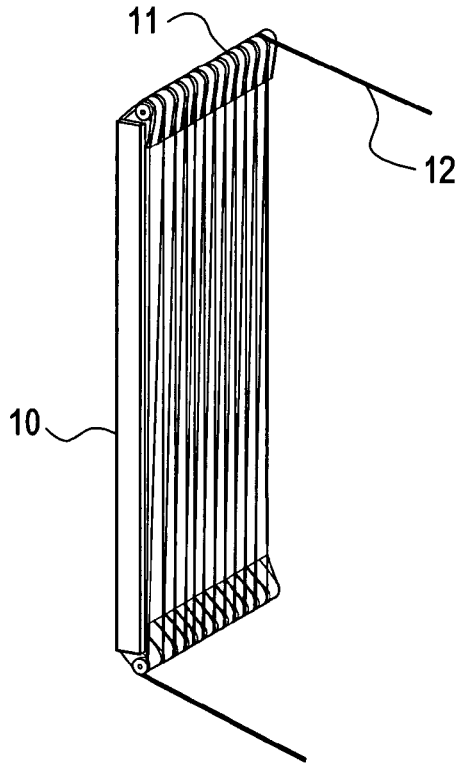
FIGS. 1*a* and 1*b* depicts the resilient panel in a relaxed and flexed state.

A resilient panel is provided that supplies resistance to an user of an exercise machine. This resistance unit allows the user to exercise effectively when mounted in an exercise machine configuration. In different embodiments of the resilient panel, the panel can be attached to the exercise equipment depending on the configuration of the particular exercise equipment. Thus, a resilient panel can be used in many different types of exercise machines and can be arranged in different orientations within a particular exercise machine. Additionally, in different embodiments of the resilient panel, the resistance of resilient panel can be adjusted to provide the user with a customized workout. Furthermore, the resistance of the resilient panel can be adjusted without interfering with the progress of the exercise. The resilient panel also possesses several embodiments wherein the resilient panel can be of different dimensions and shapes.

A resilient panel provides resistance by elastically resisting being deflected about an axis. The resilient panel deflects in one direction and then returns to its original orientation. While deflected, the resilient panel elastically stores the energy used to deflect it. One embodiment of an exercise machine utilizing a resilient panel has a resilient panel and a means of deflecting or bowing the resilient panel by applying a combination of a bending moment and compressive load to the opposing ends of the panel. The combination of a bending moment and compressive load to the opposing ends of the panel can be accomplished by an assembly consisting of a cable and pulley. One or more pulleys are positioned at each end of the panel and oriented so the cable runs between the pulleys in a direction that is perpendicular to opposing ends of the panel and offset from the neutral axis of the panel. When a force is supplied to the cable, a compressive load and bending moment is supplied at opposing ends of the resilient panel. This compressive load and bending moment causes the resilient panel to deflect. In its simplest form, the resilient panel has one set of pulleys located and attached at opposing ends of the resilient panel, with a cable running between the pulleys. In other embodiments, multiple pulleys are positioned parallel to one another at each end of the resilient panel, with the cable running from end to end of the resilient panel and through the pulleys. Additional embodiments can have more than one cable. Instead of one continuous cable, the several cables may be secured to the resilient panel at one end. The cables can then be strung through the pulleys with the other ends moving to provide force to the resilient panel.

For the purposes of this invention, the action of pulling the cable to apply a compressive load to the opposing ends of the resilient panel shall be referred to as "stroke". In addition, the term "tackle" is used to describe at least two pulleys connected by a cable that engages the pulleys. A panel that has a nearly-constant level of resistance output throughout the stroke can be achieved by taking into account the amount of offset of the pulleys perpendicular from the panel end (countering the increased bending resistance of the panel as it deflects); the number of pulleys; the offset of the pulleys from the resilient panel parallel to the direction of bending; and the dimensions and stiffness properties of the panel itself. Alternatively, other embodiments can be achieved where the same variables can be deliberately altered to deliver an increasing or decreasing level of resistance throughout the stroke. The exercise equipment can be designed to indicate in an appropriate manner the amount of resistance offered.

The stiffness of the resilient panel can be expressed by the formula:

$$R=E*I$$

Where E is the modulus of elasticity for the resilient panel and I represents the cross section moment of inertia. Both values may be calculated based on the resilient panel's geometry and composition. Similarly, the stiffness may be determined by simple measurement. By changing either, or both, the modulus of elasticity or the cross section moment of inertia, the stiffness of the resilient panel can be changed. Different embodiments of the resilient panel can allow for either the modulus or the moment of inertia to be changed, so as to vary the stiffness available to the user.

The tackle arrangement of pulleys and cable are attached to the panel in such a way that tension in the cable produces a load that is offset from the neutral axis (a plane in the panel that neither elongates nor compresses during bending) of the panel and thus produces a combination of pure bending (bending moment) and pure compression on the panel. As the panel deflects (or bows) the bending moment increases and the compressive load decreases at rates that are engineered to offset the increase in the stiffness of the panel to further deflection in a way that achieves a constant or prescribed output resistance at the cable end. The rate at which the bending moment increases and the compressive load decreases is determined by the distance that the rotational axis of the pulleys is offset from the neutral axis of the panel in the direction perpendicular to the panel, the offset from the end of the panel in the direction parallel to the panel and the length (in the direction of the cables) of the panel. If all these parameters are balanced properly it will allow the panel to deflect through its entire range in response to a nearly constant tension in the cable. Increasing tension or decreasing tension could also be achieved. The amount of cable travel afforded during the deflection of the panel is a function of the number of pulleys in the tackle arrangement and the allowable maximum deflection of the panel. The maximum panel deflection is limited by the elastic limit of the materials used and their relative locations in the panel. In addition, a means to deliberately limit panel deflection may be utilized. The resilient panel's stiffness is proportional to the modulus of elasticity of the materials used and the moment of inertia of the cross section through the panel perpendicular to the load, as discussed above, but also inversely proportional to the number of pulleys. The stiffness of the resilient panel can thus be changed by changing in various ways the relative locations of the various materials used in the panel and thus change the cross sectional moment of inertia of the panel. It can be seen that by manipulating the above design parameters, a very wide variety of nearly constant stiffness verses cable extension or shaped stiffness verses cable extension can be provided.

Figure 1B:
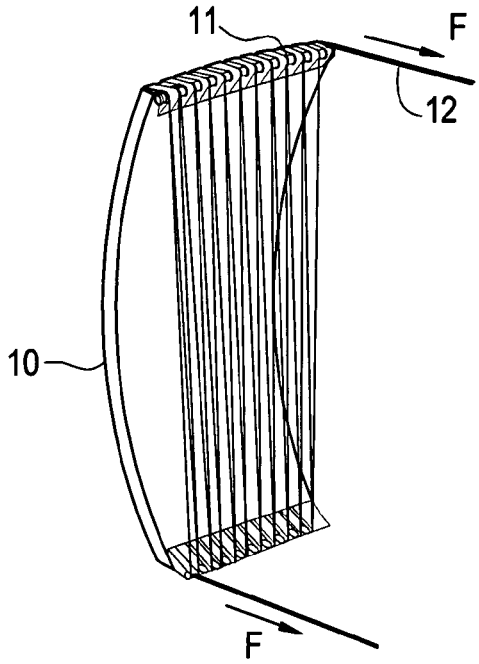
Figure 2:
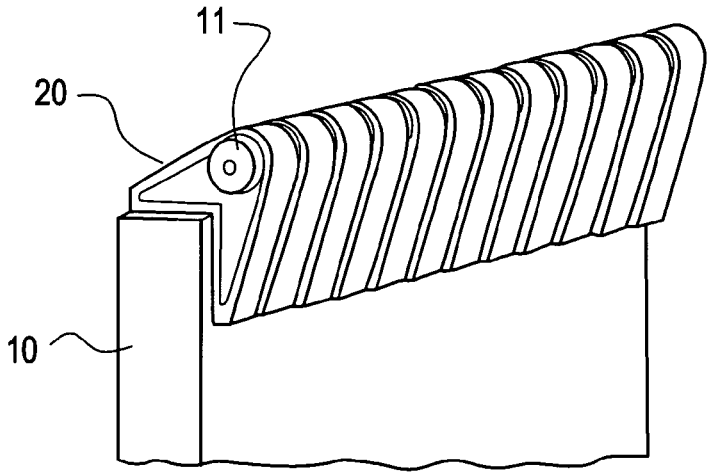
FIG. 2 depicts the edge of the resilient panel.

As shown in FIGS. 1*a* and 1*b*, a resilient panel 10 is provided with cables 12 and pulleys 11. When force F is applied, a relaxed resilient panel shown in FIG. 1*a* is compressed as shown in FIG. 1*b*. FIG. 2 shows a close up of the edge of the resilient panel 10 where the pulleys 1 are supported by ribs 20. The ribs 20 also provide a slot for the cable (not shown) to pass through. The deflecting of the panel provides resistance.

Because the panel does not depend upon gravity to generate resistance, the panel can effectively be used in any position. This makes it convenient to utilize the resistance panel in embodiments where the panel is connected to an exercise apparatus. For example, the panel can be effectively used where the resistance unit also serves as a platform on which the user stands; the resistance unit also serves as a platform on which the user sits or lays; or where the resistance unit attaches to a wall or door. Additionally, a variety of standard weight lifting attachments can be used in combination with the resilient panel, cables and pulleys, as required. Many embodiments can have the resilient panel secured to an exercise machine so that the resilient panel provides weight like resistance to the user of the exercise machine. Different embodiments can allow different size bars to be attached to the cables to deliver different types of exercise. Thus, the free ends of the cable or cables may be attached to different exercise attachments so that the exercise equipment user transmits a force to the cable in order to compress the resilient panel. The resilient panel can be secured depending on the configuration of the exercise machine. Any number of common means can be used to attach the cable to the exercise attachments.

Figure 21:
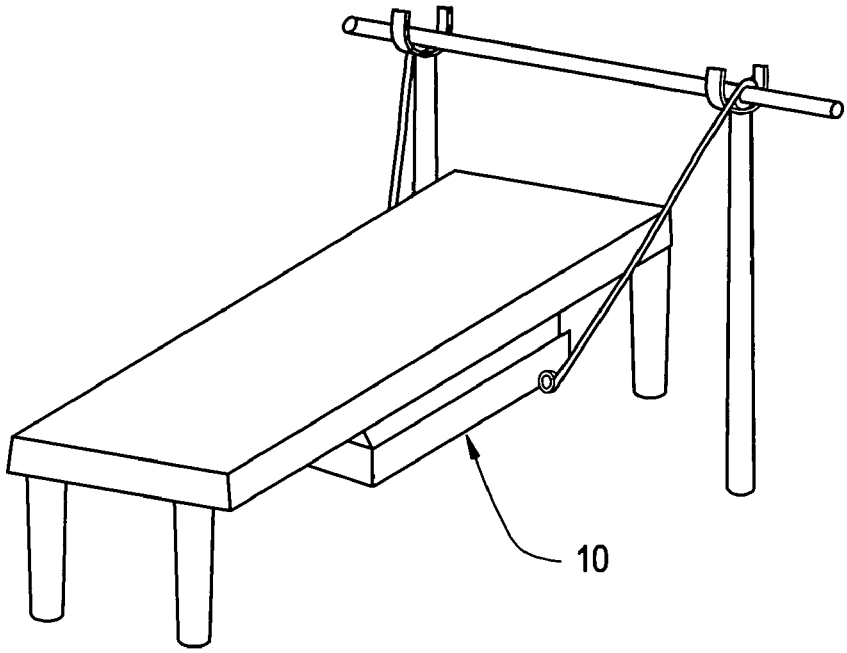
FIG. 21 depicts the resilient panel in a weight bench configuration.
Figure 22:
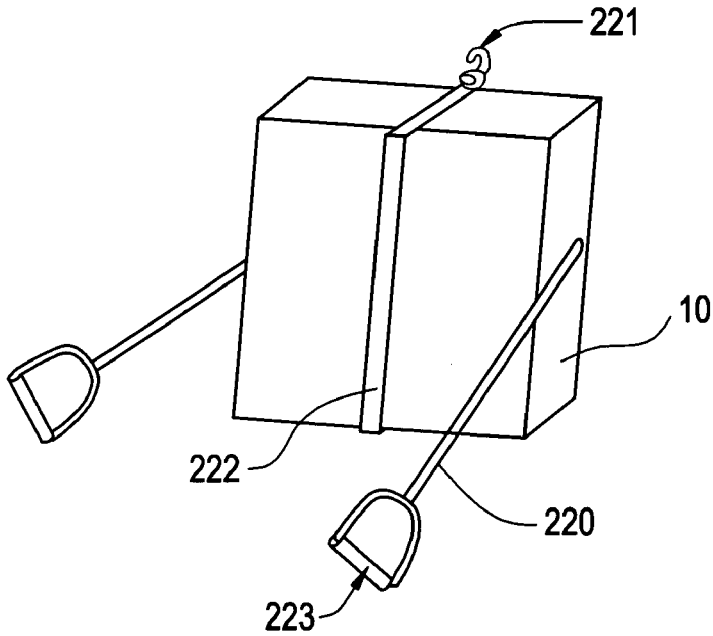
FIG. 22 depicts the resilient panel in a wall mounted configuration.
Figure 23:
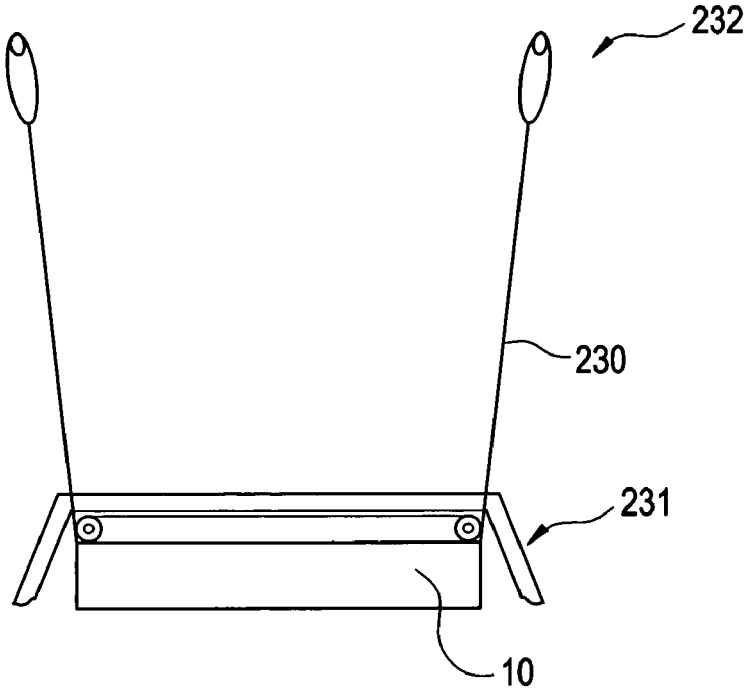
FIG. 23 depicts the resilient panel in a floor mounted configuration.

FIG. 21 demonstrates a resilient panel 10 used in a bench press configuration. FIG. 22 shows a wall mounted resilient panel 10 configuration. The resilient panel 10 can be mounted by a mounting bracket to the wall. Or the resilient panel can be attached to the wall with a hook 221 and strap 222 type system. The user grips the handle 223 that is connected to the resilient panel by cable 220. FIG. 23 shows a resilient panel 10 that is floor mounted. The user can step on a support 231 while exercising by moving the grips 232 that are connected to the resilient panel 10 by cables 230.

Because the resilient panel achieves its resistance internally, without additional weights, one embodiment of a resistance panel can be compact as 40" high by 12" wide by 4" thick Despite its size, the resilient panel can achieve a range of weight-like resistance to a user ranging from as low as eight pounds to as high as four hundred pounds with the use various embodiments of stiffening agents that will be described below. However, the resilient panel unit can be sized according the particular needs of a workout system. Of course, the initial shape of the panel determines the dimensions of the panel. Accordingly, the modulus of elasticity, the strength of the various materials used in its construction, the location of those material relative to the neutral axis of bending, the ratio of compressive load to bending load imposed by the tackle arrangement of pulleys and cable, and the number of pulleys will ultimately determine the dimensions of the panel. Accordingly, the panel can be used in many different types and sizes of exercise apparatus, ranging from large stationary apparatus with many work out stations or positions, to small, highly portable apparatus.

One embodiment of the resilient panel is made out of rigid polyurethane foam. Nonetheless, the resilient panel can be manufactured out of any material that provides the resilient panel with an appropriate resistance to deflecting. These materials include metals, composites, plastics and wood that possess appropriate resistance characteristics.

In one embodiment, the number of pulleys is changed to change to affect the resistance of the resilient panel. Using a greater number of pulleys results in a greater mechanical advantage of the tackle portion of the design. Thus, there is less effort required to pull on the cable. However, an increase in the number of pulleys also requires an increase of the length of the cable used in the tackle portion of the design. This can contribute to an undesirable increase in the amount of friction and resistance. Using fewer pulleys can reduce the amount of friction, but also can reduce the range of travel afforded the cable, and thereby reducing the effective range of motion in the exercise apparatus. In addition, the size of the cable and the material of the cable can also affect overall friction. Depending on the embodiment, additional friction may or may not be desirable. Friction increases resistance in one direction and reduces it in the other. This is generally seen as undesirable for weight training, but could be desirable under some circumstances such as for rehabilitation or where safety is a concern.

Figure 25:
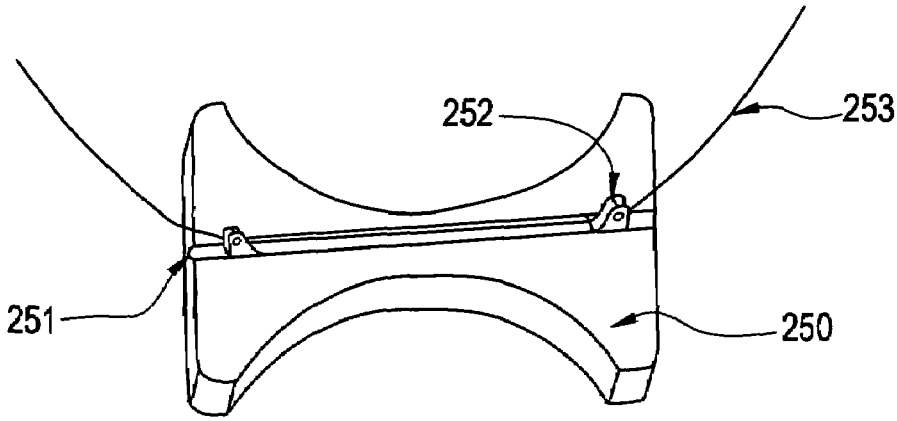
FIG. 25 depicts a resilient panel with resistance increasing geometry.
Figure 26:
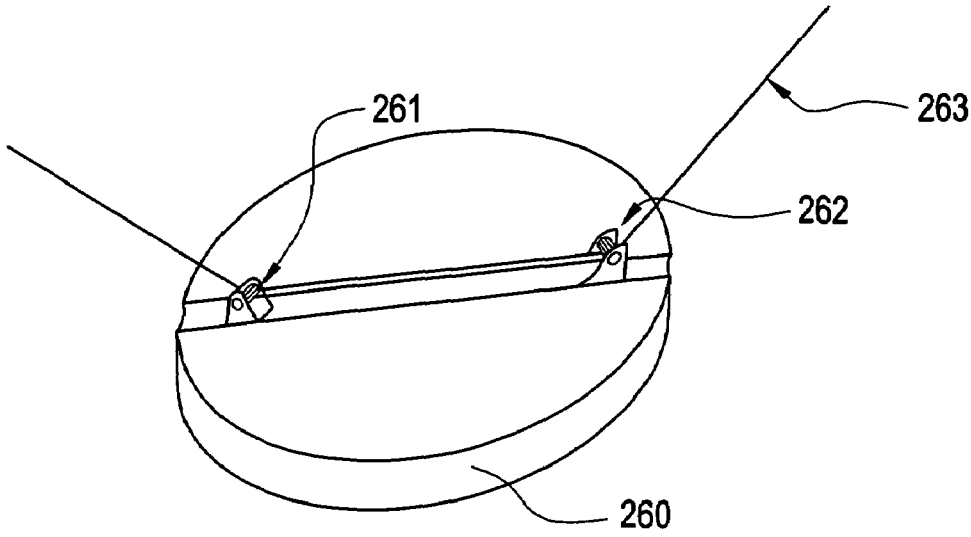
FIG. 26 depicts an ovoid resilient panel.

In another embodiment, the positioning of the pulleys on the panel can be changed. Different amounts of leverage exerted by the pulley assembly on the panel can be achieved by the positioning of the pulleys relative to the length of panel. Moving the point of rotational axis of the pulleys further away from the neutral axis of the panel causes more leverage to be exerted by the pulley system on the panel. Thus, there is less effort required to pull on the cable. In other embodiments, it can be advantageous to employ a resilient panel that is not necessarily rectangular in shape. When a resilient panel with non rectangular geometry is used in combination with movable pulleys, resistance can vary depending on where the pulley is attached. For example, FIG. 26 depicts an ovoid shape resilient panel 260 with movable pulleys 261 and 262 with cable 263. Moving the pulleys inward results in a non-linear decrease in resistance. Similarly, FIG. 25 depicts a resilient panel having expanding geometry 250. As the pulleys 252 are moved outward, the resistance is nonlinearly increased because the width of the panel is increased. Resistance increases nonlinearly as the pulleys 252 are moved outward.

Figure 24A:
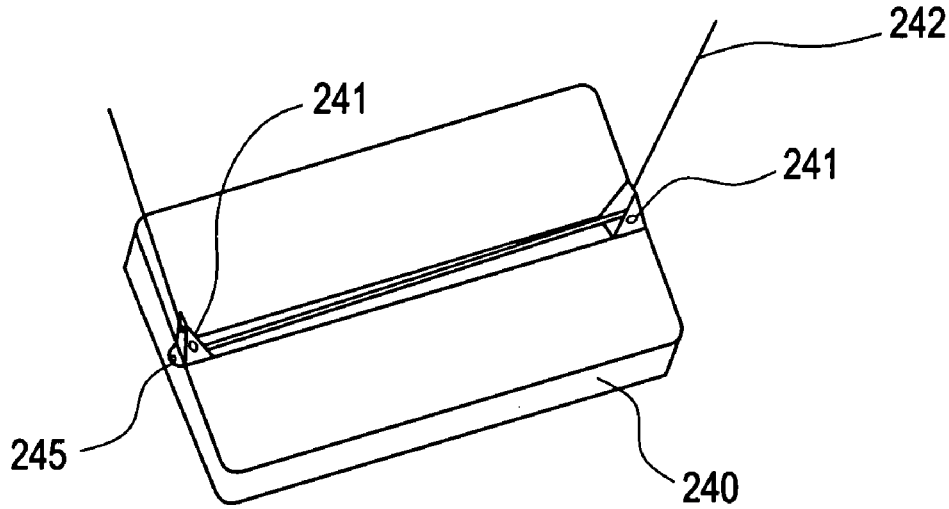
FIGS. 24*a* and 24*b* depict a resilient panel with movable pulleys.
Figure 24B:
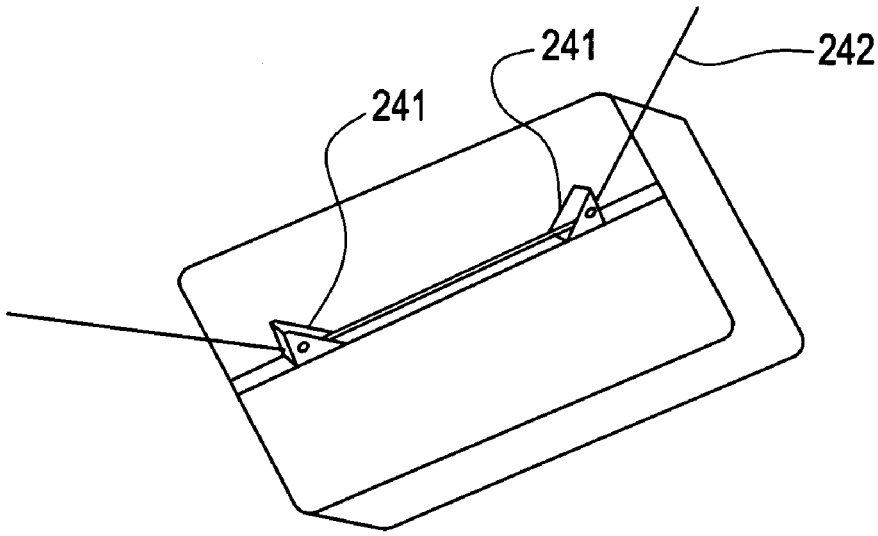

FIGS. 24*a* and 24*b* depicts a movable pulley type resilient panel 240 with movable pulleys 241 on which cables 242 move. FIG. 24*a* depicts the pulleys at an outermost position, while FIG. 24*b* shows the pulleys moved inward. As a result of the change in pulley arrangement, resistance is changed. In this embodiment of the movable pulley type resilient panel 240, the pulleys 241 are moved and guided along a track 245. Any movement or change in the number of pulleys changes the resistance. Other embodiments can likewise utilize different means for relocating the pulleys, such as pinholes.

Figure 27:
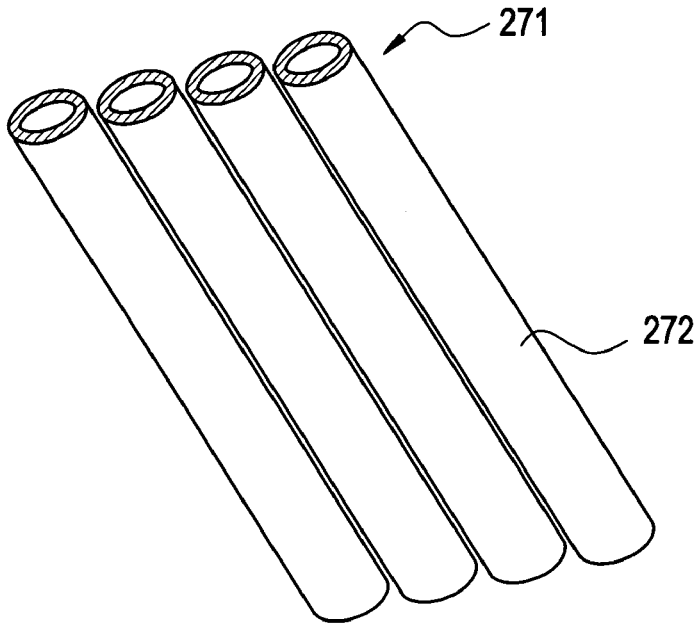
FIG. 27 depicts a resilient panel consisting of interlocking tubes.
Figure 29:
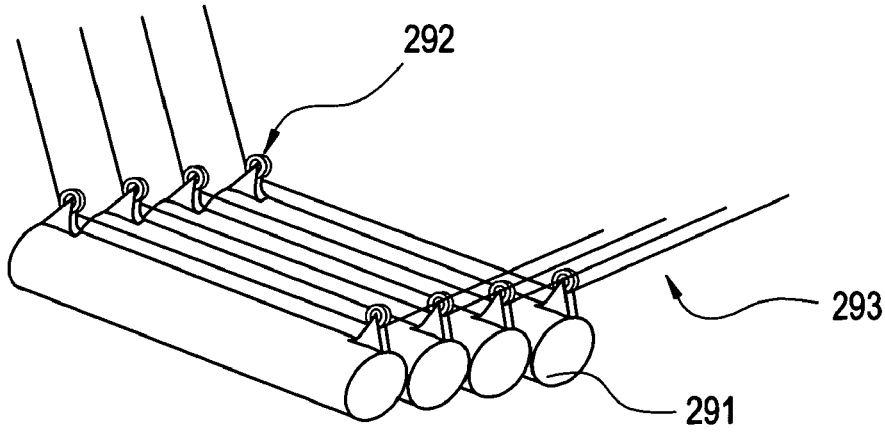
FIG. 29 depicts a tube based resilient panel with pulleys.
Figure 30:
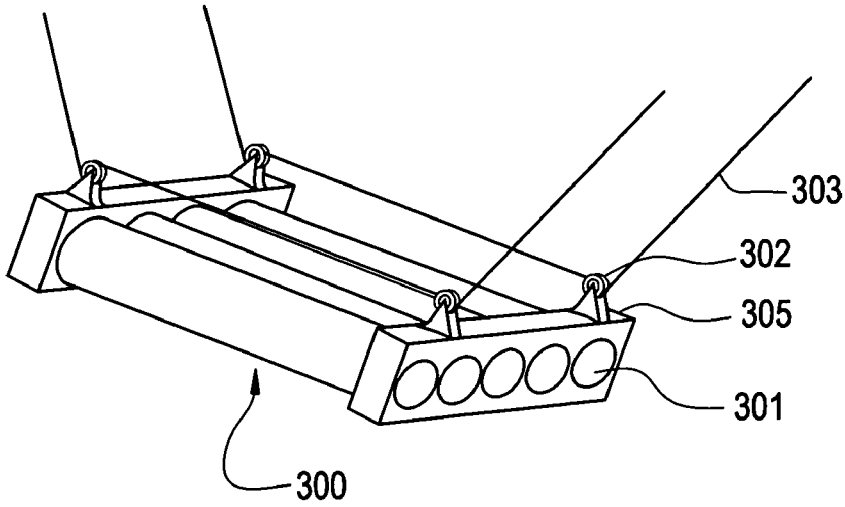
FIG. 30 depicts a tube based resilient panel with an end piece and pulleys.

In another embodiment of the resilient panel, the resilient panel can be constructed of tubes. The tubes can be configured so as to create a panel as depicted in FIG. 27. The tube based resilient panel can have interlocking tubes or can be attached by other means. The tube based resilient panel 271 consists of an arrangement of tubes 272. The tube based resilient panel can have pulleys attached at the ends of the tubes, on the tubes. Additionally, the pulleys can be attached to the tubes in manner where a pulley is connected to many tubes at once. FIG. 29 depicts a tube based resilient panel 291 with pulleys 292 and cables 293. The pulleys 292 are attached to the ends of the tubes. In one such embodiment, the tubes can be arranged in a flat arrangement and connected. FIG. 30 depicts an embodiment where the tube based resilient panel 300 has pulleys attached to an end piece 305. The end piece is connected to all of the tubes 301. The end piece is able to transmit the force from the cables 303 to the resilient panel 300.

Figure 28:
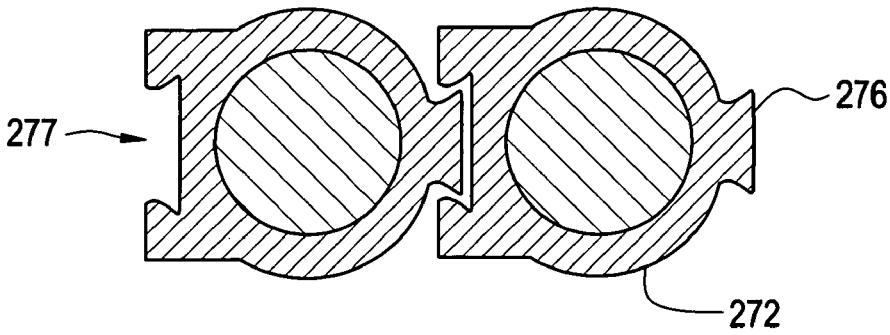
FIG. 28 depicts a cross section of a resilient panel made of interlocking tubes.

In another embodiment of the tube based resilient panel, the tubes can be arranged in a flat arrangement and connected. FIG. 28 depicts the cross section of an embodiment of the resilient panel consisting of connected tubes. The tubes 272 are connected to each other by protruding guides 276 and grooves that receive the guides 277. As shown in FIG. 28, the guide 276 and grooves 277 fit the tubes tightly together. The arrangement allows for all the tubes to contribute to the stiffness of the resilient panel 271, and to share motion.

In embodiments that employ a tube based resilient panel, the tubes can be constructed so as to have grooves and guides, or other methods of connecting the tubes together, so as to move together and to contribute to the resilient panel's stiffness. In addition, the resulting stiffness of the resilient panel can be affected by the materials, which make up the tubes and to the configuration of the tubes themselves. In one embodiment, the tubes can be constructed of PVC, ABS or other material with the proper stiffness characteristics, including metal. The use of PVC allows for easy and cheap construction of the tubes. A long tube with guides and grooves can be manufactured and then cut into equal lengths, and then be arranged into a tube based resilient panel.

Adjusting the cross sectional moment of inertia of the panel is another method of adjusting resistance. Changes in the moment of inertia can be achieved in a variety of ways. For example, the thickness of the panel can be changed. A panel with more thickness would be stiffer than a panel with less thickness, all other factors being the same. In one embodiment, a panel can have outer surfaces that are moveable closer to and away from each other, thereby decreasing or increasing the relative thickness of the panel and, thus, the stiffness of the panel. In several embodiments of a resilient panel, a resilient panel that can change its relative thickness without changing the amount of material composing the resilient panel. In these embodiments, the resilient panel can employ a pneumatic, hydraulic or mechanical device to change its thickness dimension. These embodiments can deliver force to both sides of the resilient panel in order to drive apart, or close together, the walls of the resilient panel. In addition, the various methods for changing the thickness dimension can also be controlled manually, or by computer. Embodiments of the resilient panel that utilize a thickness changing device should have an appropriate guiding mechanism to ensure that the several pieces required will remain aligned.

Figure 7:
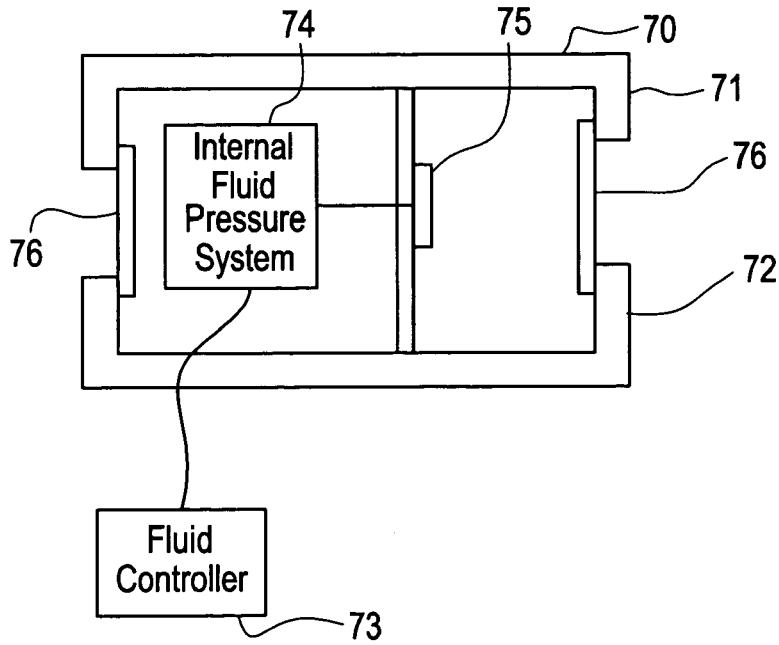
FIG. 7 depicts a resilient panel that adjusts its resistance by fluid pressure.
Figure 8A:
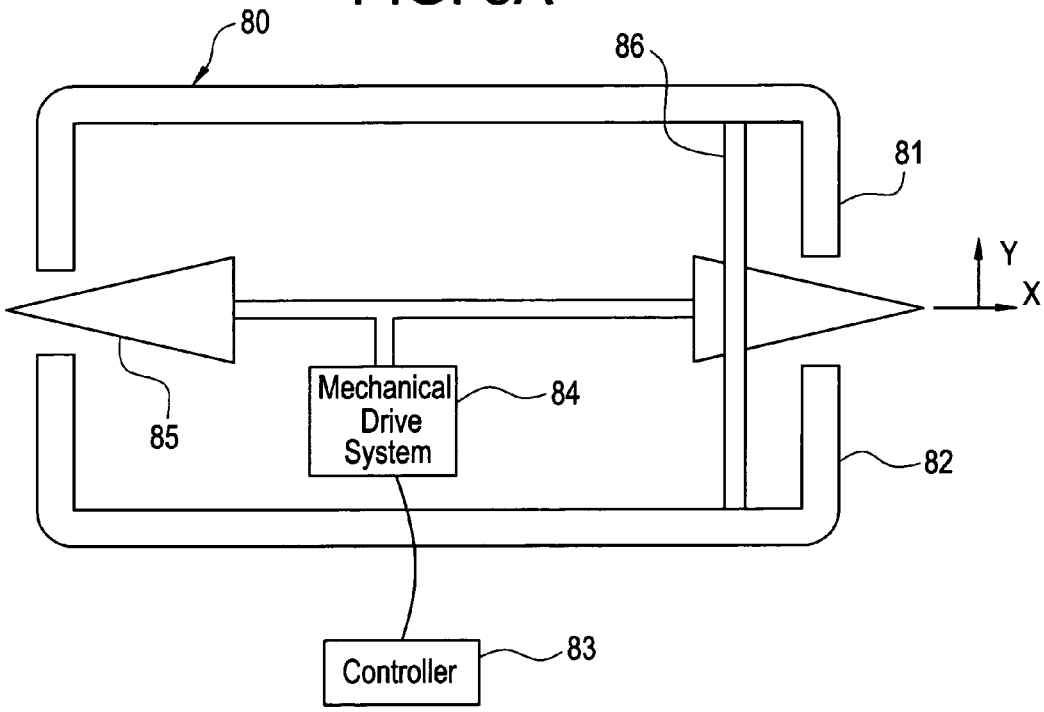
FIGS. 8*a* and 8*b* depict a resilient panel that adjusts its resistance by mechanical means.
Figure 8B:
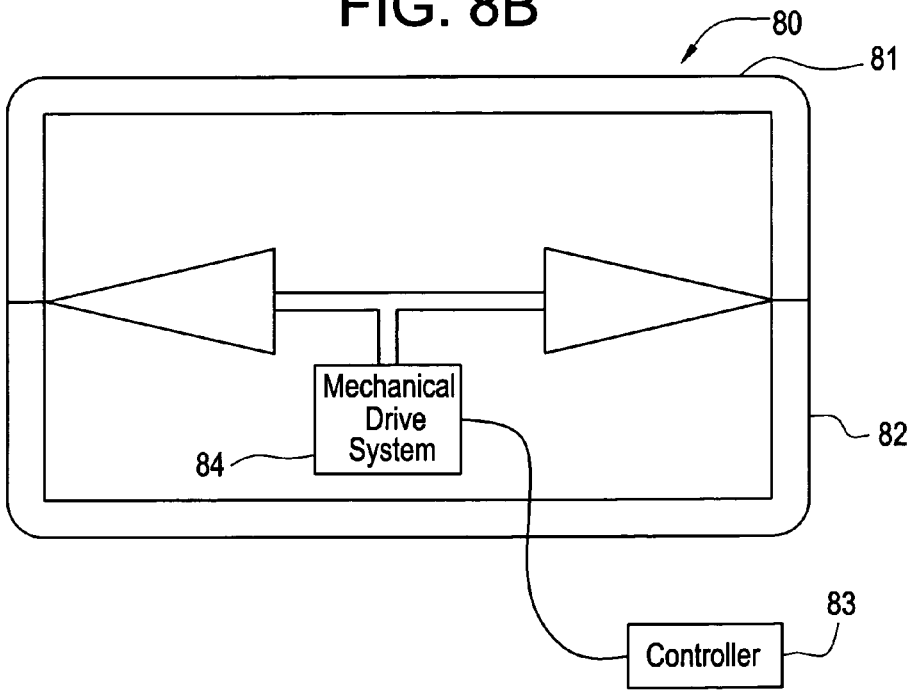

FIG. 7 discloses an embodiment of an adjustable thickness resilient panel 70. The panel 70 has at least two outer parts that move 71 and 72 so that the outer dimensions are changed. The internal fluid pressure system 74 is controlled by fluid controller 73. The internal fluid pressure system transmits the pressure through an actuator. The outer panel parts 71 and 72 are displaced by the actuator 75. Internal guide 76 ensures alignment of the outer panel parts 71 and 72 during use. FIGS. 8*a* and 8*b* demonstrate a resilient panel that utilizes a mechanical thickness changing system 80. In this embodiment, wedges 85 are displaced along the lateral direction x to force moving outer panel parts 81 and 82 in the longitudinal direction y. As shown in FIG. 8*a*, which shows the resilient panel 80 in the open position, the wedges 85 are moved outwards. FIG. 8*b* shows the resilient panel 80 in the closed position. As the wedges 85 are pulled internally, the panel thickness is decreased and the panel resistance is decreased accordingly. The wedges 85 are controlled by a mechanical drive system 84, which is controlled by the controller 83. Internal alignment part 86 ensures that the outer panel parts 81 and 82 remain aligned during use.

Figure 4:
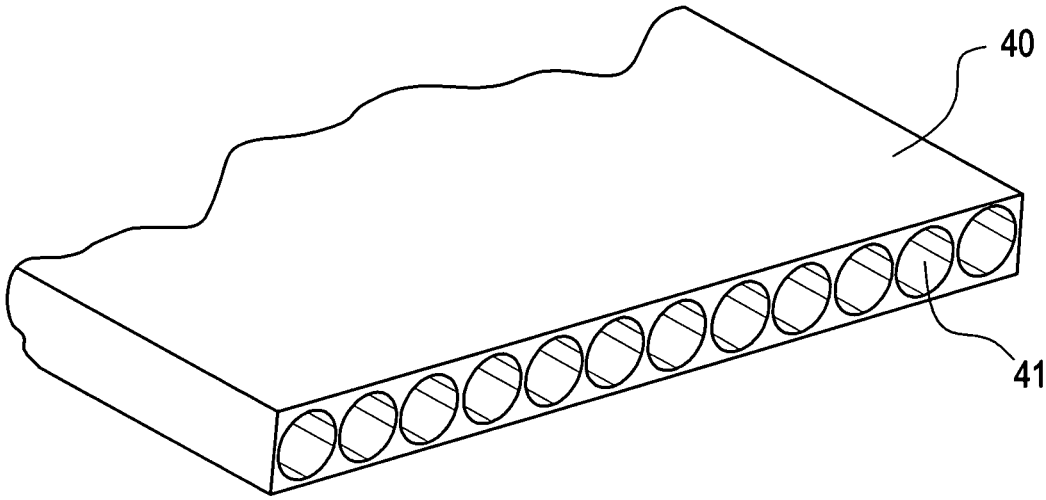
FIG. 4 depicts a resilient panel with openings for insertion of reinforcing rods.
Figure 17:
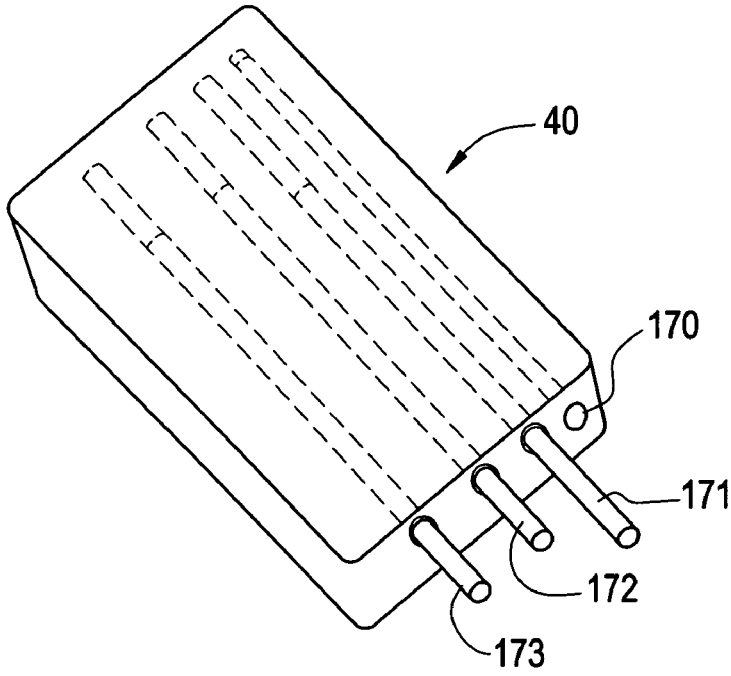
FIG. 17 depicts a resilient panel with reinforcing rods inserted to various depths.

Resistance can be changed by addition or subtraction of reinforcements to the panel. The addition or subtraction of reinforcements to the resilient panel can have the effect of changing the dimensions of the resilient panel, thus affecting the cross section of inertia. Additionally, if the reinforcements are made of different materials, the modulus of elasticity of the resilient panel can be changed. One embodiment of the panel utilizes rods inserted into cavities positioned lengthwise in the panel to add desired levels of stiffness would be very simple and inexpensive to manufacture. Changes in stiffness in an embodiment where rods, plates or other shapes intended to serve as stiffening agents inserted into, or removed from the inside of the panel would be achieved using rods or plates of differing stiffness, by varying the number of rods used, by the varying the depth the rods are inserted into the panel cavities, or by a combination of all the above. FIG. 4 shows an internally reinforced resilient panel 40 with various openings 41 provided for reinforcing rods to be inserted. FIG. 17 shows resilient panel 40 with reinforcing rods 170, 171, 172, and 173 in various states of entry into the panel.

Figure 5:
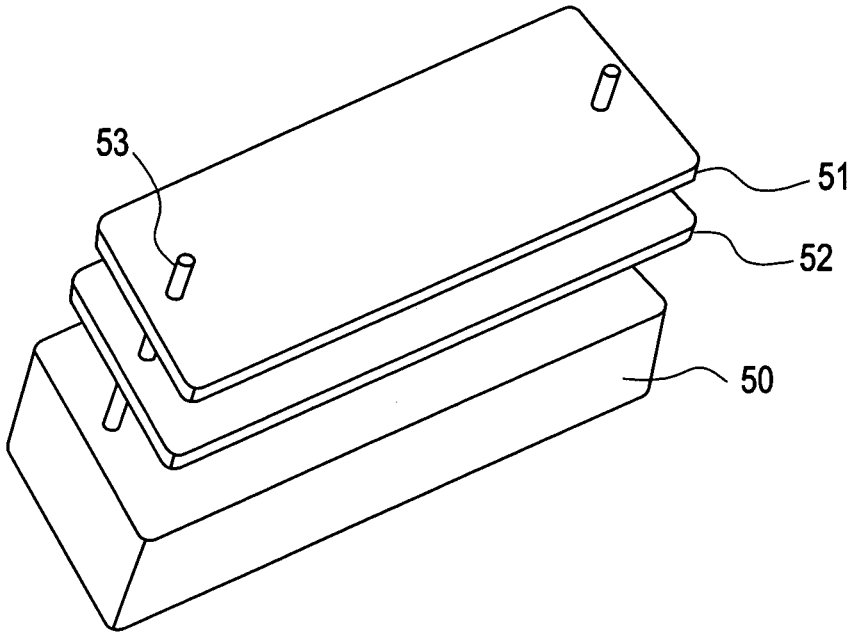
FIG. 5 depicts a resilient panel with external reinforcing plates.
Figure 6:
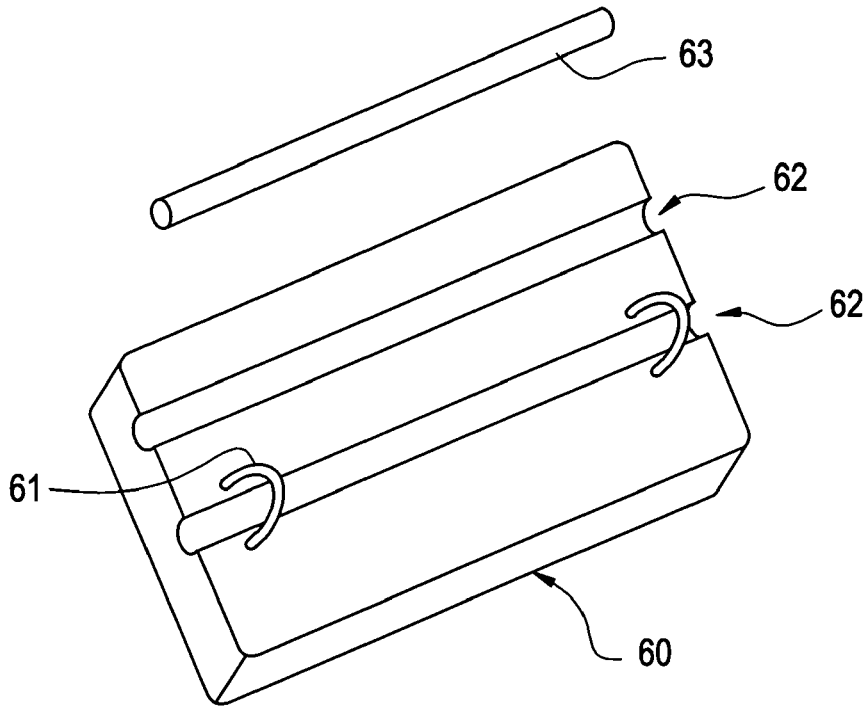
FIG. 6 depicts a resilient panel with external reinforcing rods.
Figure 18:
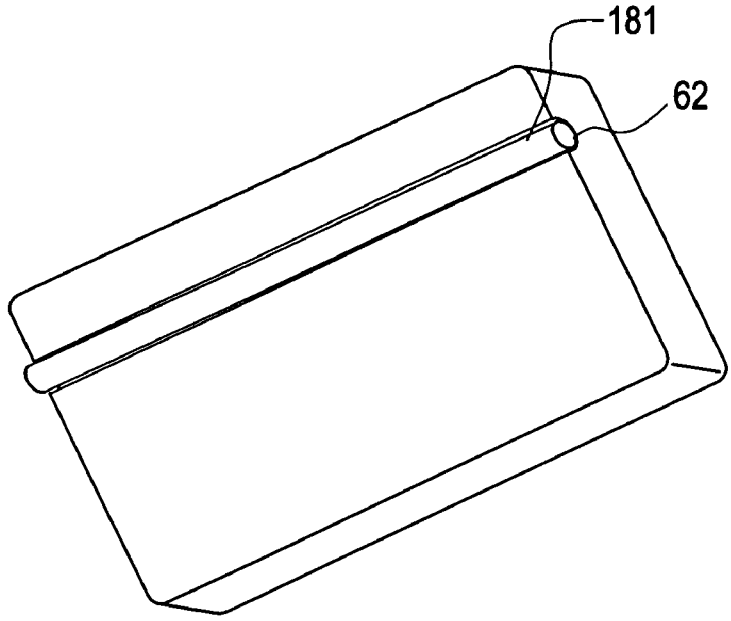
FIG. 18 depicts a resilient panel with reinforcing rods affixed to panel.
Figure 19:
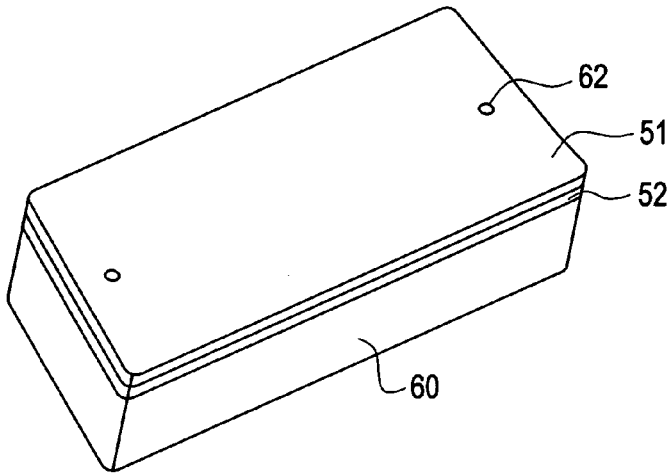
FIG. 19 depicts a resilient panel with external plates attached.

Another embodiment of the panel has rods, plates or other shapes intended to serve as stiffening agents. The rods, plates or other appropriate shapes are affixed to, or removed from the outside surface of the panel. Changing the resistance of the resilient panel can be accomplished by using rods or plates of differing stiffness, by varying the number of rods used, by the varying the position of the rods relative to the panel surface, or by a combination of all the above, so as to change the relative stiffness of the panel. FIG. 5 shows an embodiment where additional plates 51 and 52 are to be placed on the externally reinforced resilient panel 50. Guide 53 secures and locates the reinforcement panels 51 and 52 on to the resilient panel 10. FIG. 19 further shows the resilient panel 50 with plates 51 and 52 attached. Likewise, FIG. 6 shows another externally reinforced resilient panel 60 that has grooves 62 for the placement of reinforcing rod 63. Alignment piece 61 ensures that the reinforcing rod 63 stays in place during compression. FIG. 18 shows the resilient panel 60 with reinforcing rod 181 inserted into a groove 62.

Figure 3:
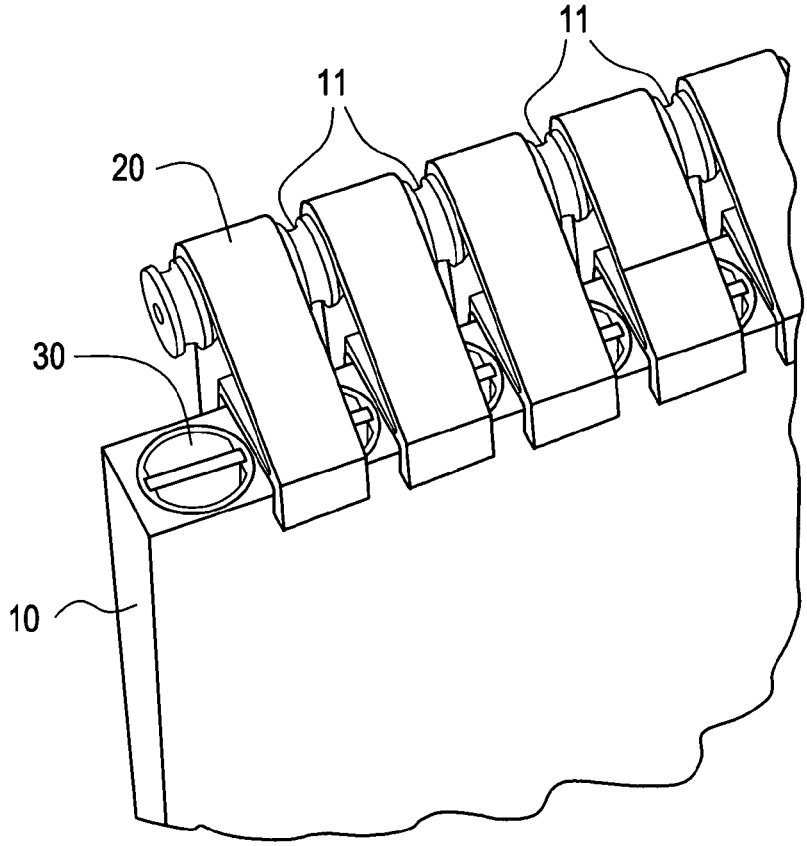
FIG. 3 depicts a closer view of the edge of a resilient panel.
Figure 15:
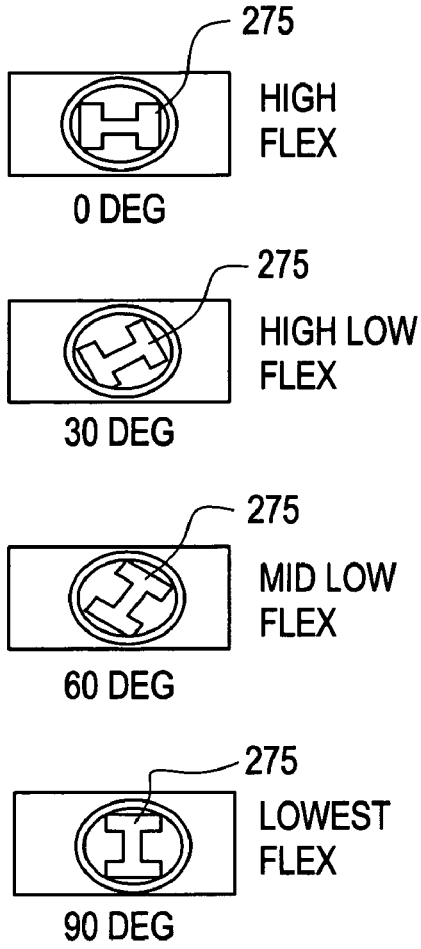
FIG. 15 depicts progressive views of the flexure resistance spine of FIG. 14 shown in different relative positions.
Figure 16:
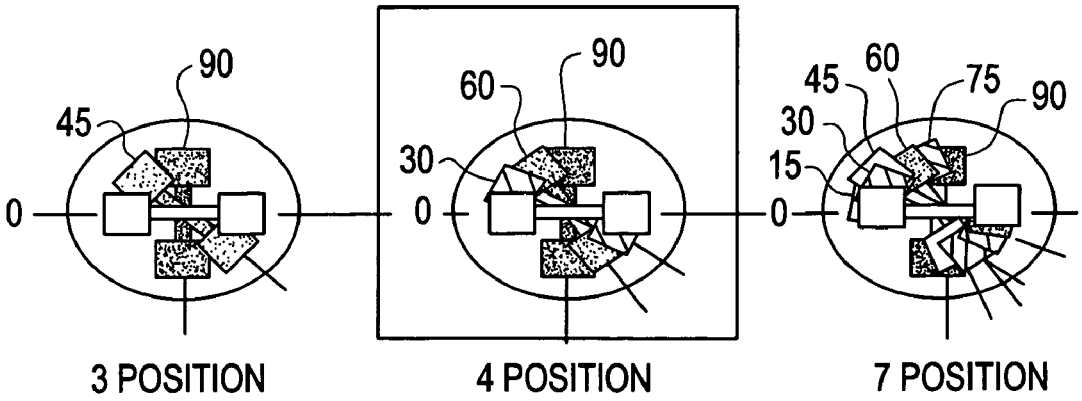
FIG. 16 depicts the flexure resistance spine of FIG. 14 shown movable between three, four and seven relative position settings.

One embodiment of the panel utilizes cavities into which flexure resistance spines are inserted, providing an easy way to achieve and adjust a wide range of resistance levels. FIG. 3 shows a resilient panel 10 into which flexural resistance spines 30 are inserted. In FIG. 15, the flexure resistance spine 141 can have an I-shape 275, or any other type of shape. In another embodiment, the shape of the flexural resistance spine can be tapered, so that one end of the tapered flexural resistance spine has a greater diameter than the other end. By rotating the flexural resistance spine within the resilient panel, the resilient panel's resistance to bending can be changed. As best seen in FIG. 16, the I-shape 270 changes its relative position within the resilient panel dependent upon the position that it is rotated.

In one embodiment, the flexure resistance spines would be rotated to and secured in the desired stiffness position. In other embodiments, motors, timers, computers, and the like are employed to rotate the flexure resistance spines. The use of the motors make changes to panel stiffness automatic and eliminate the need for the user to effect a manual change of stiffness adjustment. Accordingly, the resilient panel can change resistance during the exercise without requiring the exercise to stop. The computer can also be connected to a display to indicate the amount by which the flexure resistance spines are rotated.

Figure 20:
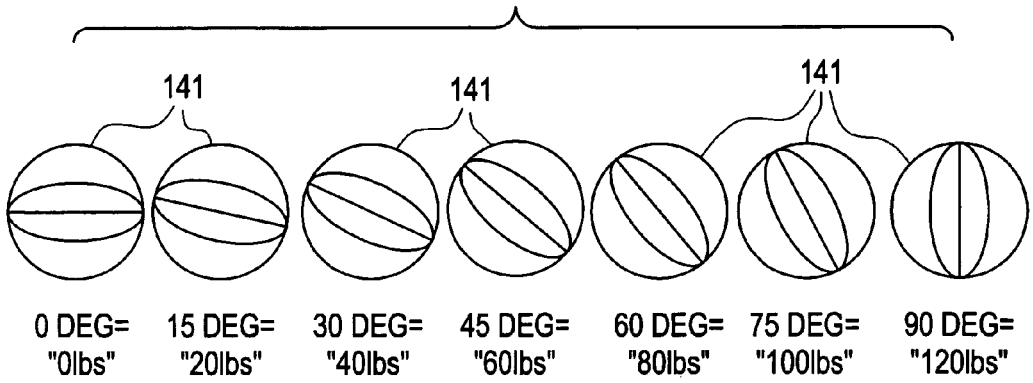
FIG. 20 is a schematic representation of a series of progressive views of a flexural resistance spine being rotated in a clockwise direction into different relative angular positions to vary stiffness and resistance characteristics in a given direction.

Other embodiments can be used to effectively control the rotation of the flexural resistance spine. FIG. 20 demonstrates the effect of rotating the flexural resistance spine 141. Rotating the spine 141 effectively changes the moment of inertia and thus the stiffness on the resilient panel resistance of the resilient panel. An embodiment containing flexural resistance spines can utilize flexural resistance spines that are tapered. The resilient panel will have corresponding tapered cavities to house the tapered flexural resistance spines. The tapered cavities and tapered flexural resistance spines prevent deflection or unwanted rotation of the flexural resistance spine.

Figure 9:
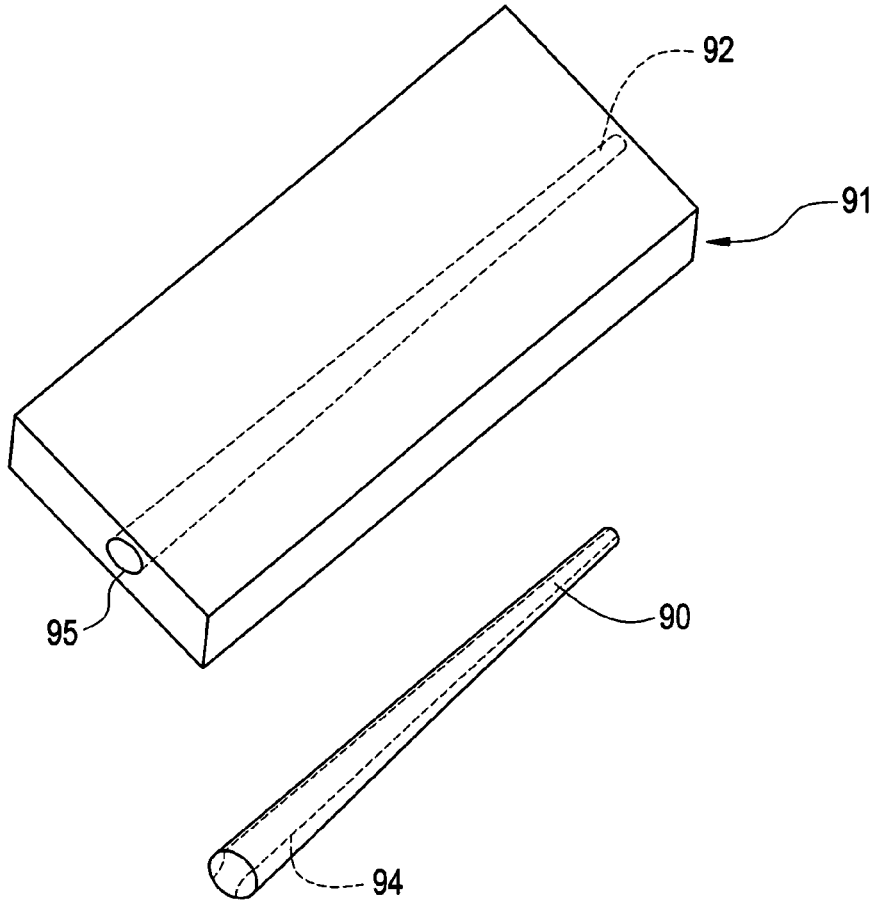
FIG. 9 depicts a flexural resistance spine that is tapered.
Figure 10:
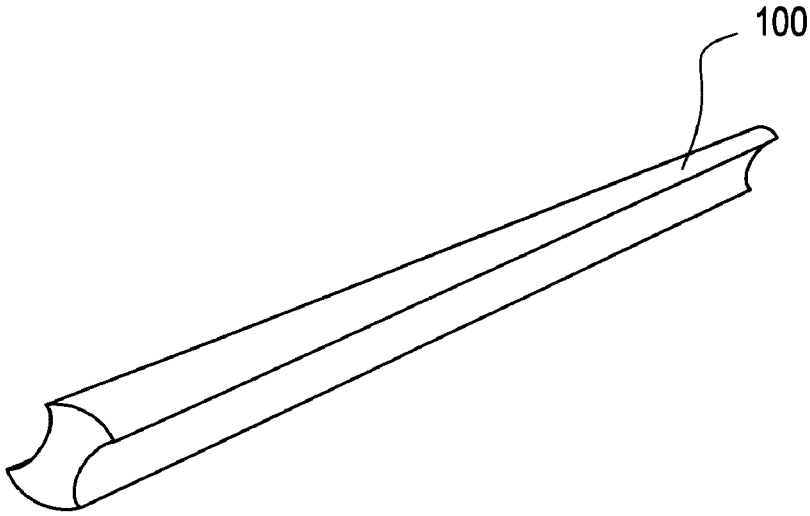
FIG. 10 depicts a shaped tapered flexural resistance spine
Figure 11:
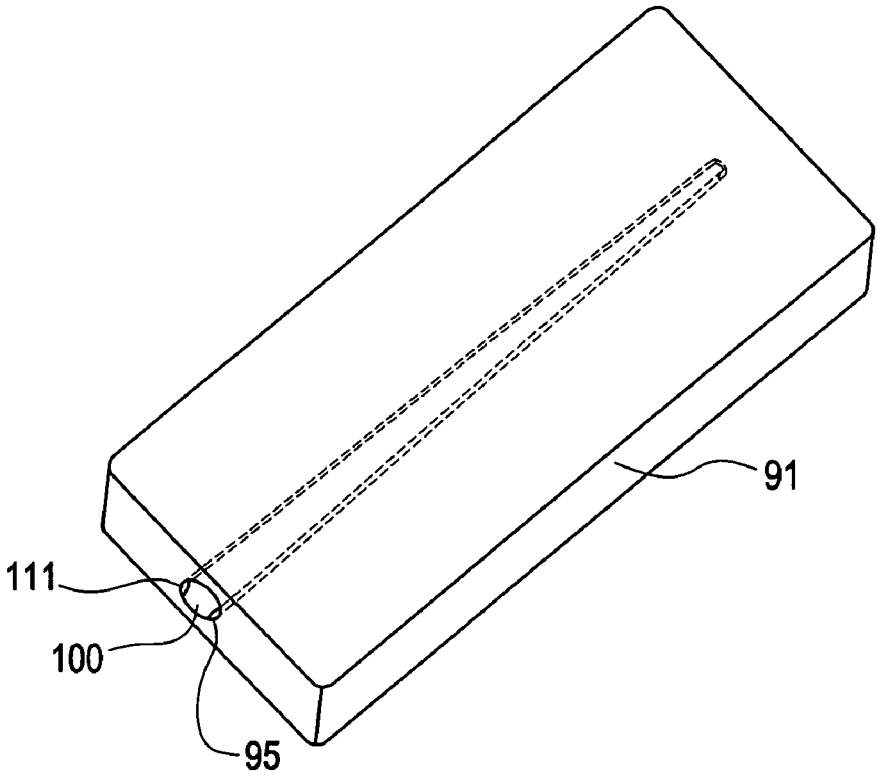
FIG. 11 depicts a resilient panel with a tapered flexural resistance spine inserted.
Figure 12:
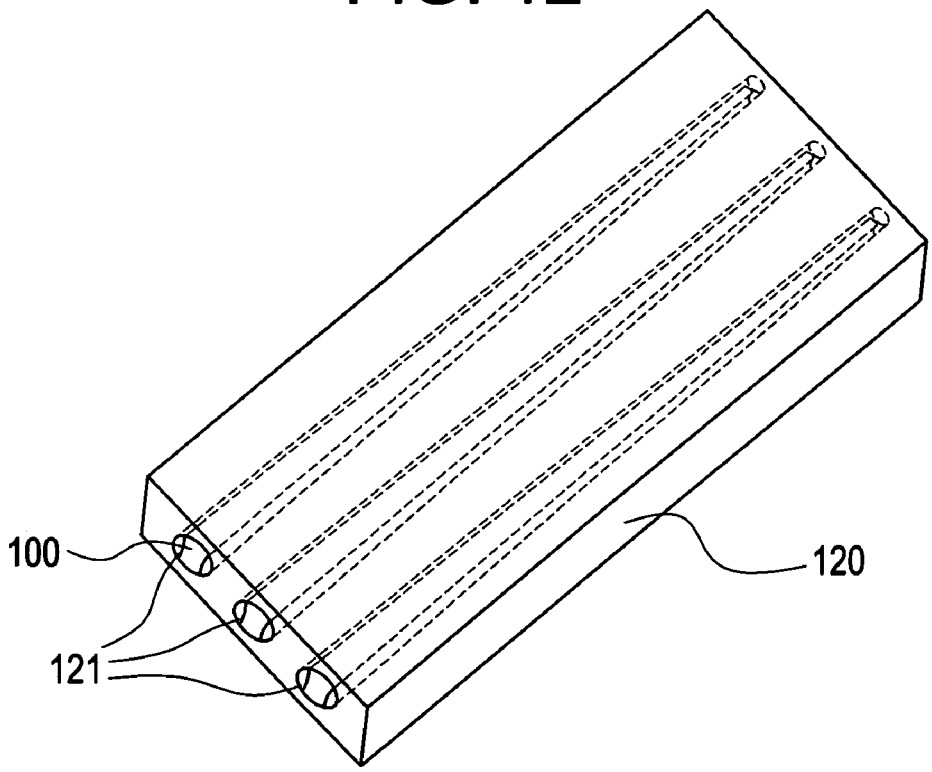
FIG. 12 depicts a resilient panel having multiple tapered cavities

FIG. 9 depicts a flexural resistance spine that is tapered 90. The outer diameter of the spine matches that of the inner diameter of a cavity 92 placed in a resilient panel 91. Material is removed from the flexural resistance spine 90, as shown by the scoring 94. As shown in FIG. 10, the resulting flexural resistance spine 100 is tapered with material removed along the length of the shaft. FIG. 11 depicts the tapered flexural resistance spine 100 that is inserted into the resilient panel 91. The outer diameter of the tapered flexural resistance spine 100 matches that of the inner diameter of the cavity 92, providing contact along the length of the spine with the resilient panel inner walls 95 except for where the tapered flexural resistance spine 100 has had material removed shown in 111. FIG. 12 depicts the resulting tapered multi cavity resilient panel 120 having 3 tapered cavities 121, each fitted with a tapered flexural resistance spine 100. As the tapered flexural resistance spines 100 are rotated, the resistance of the tapered multi cavity resilient panel is changed. The rotation of the tapered flexural resistance spines can be controlled individually or separately.

Figure 13:
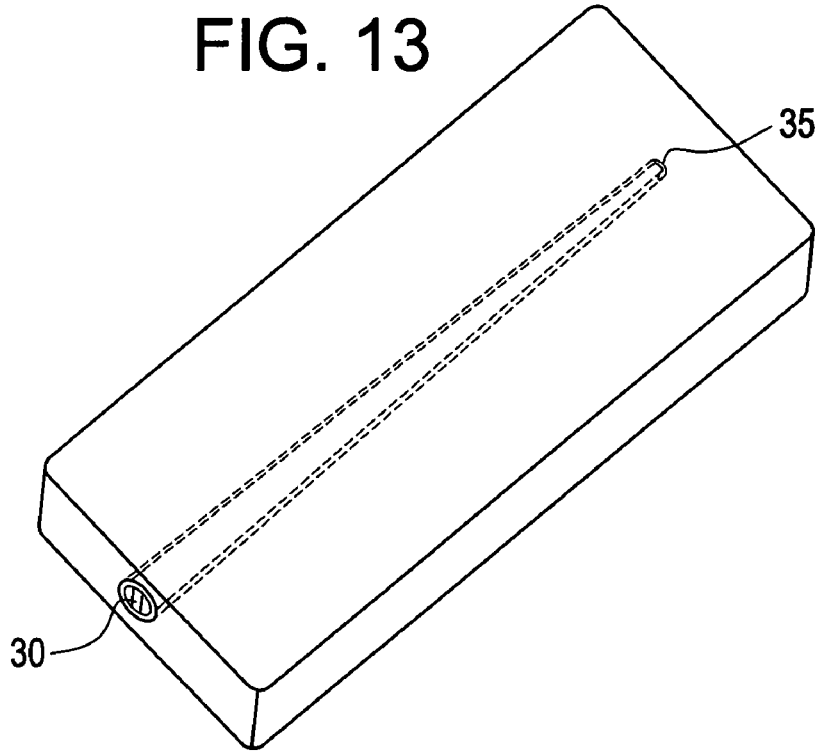
FIG. 13 depicts an adjustment mechanism for a flexural resistance spine.
Figure 14:
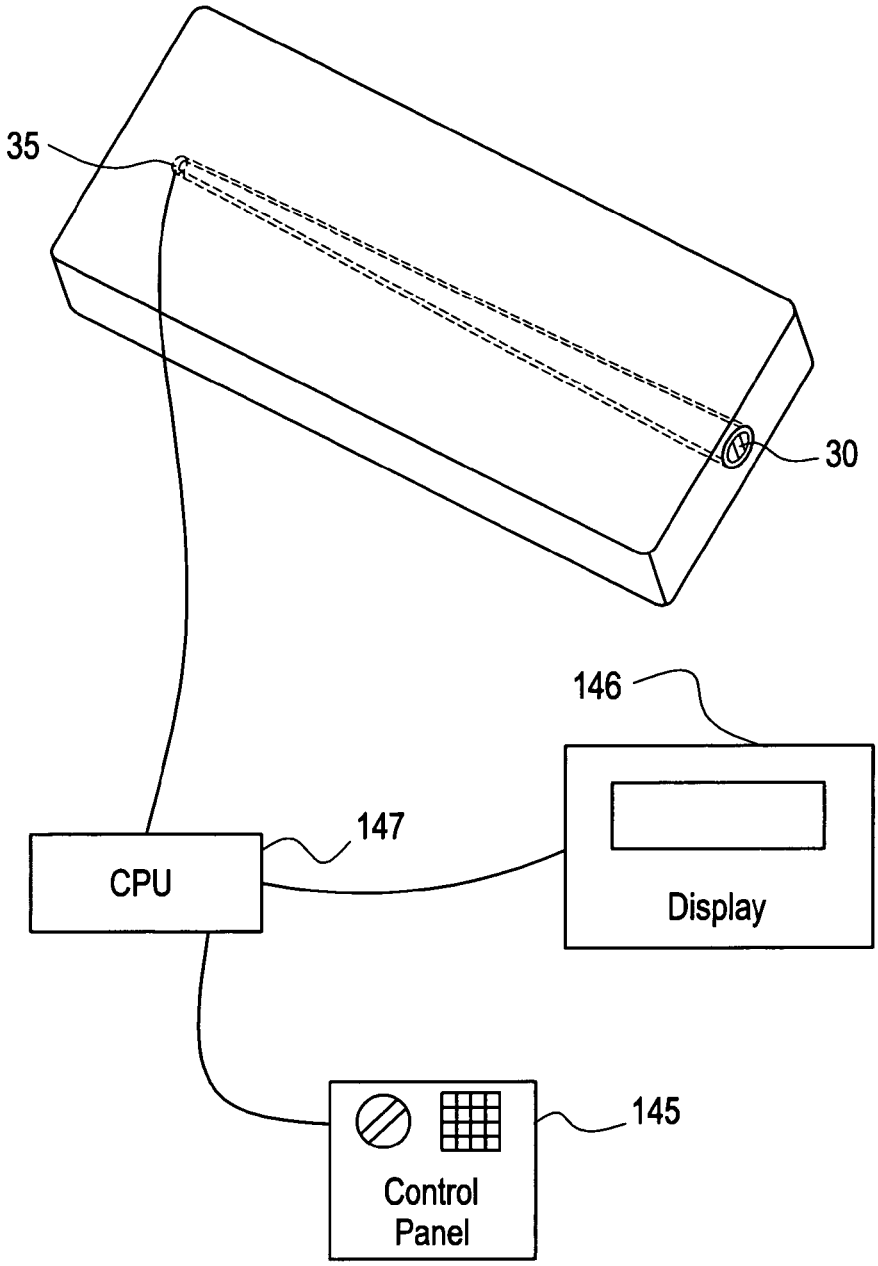
FIG. 14 depicts controlling the adjustment mechanism for a flexural resistance spine.

FIGS. 13 and 14 depict one embodiment that can control the rotation of the flexure resistance spines 30. The flexure resistance spine 30 is provided with an adjustment mechanism 35 that provides rotational force and control so as to properly position the flexure resistance spine. FIG. 14 depicts an embodiment that can control the adjustment mechanism 35 through a computer, or a central processing unit (CPU) 147. The CPU 147 is linked to a display 146 and a control panel 145. The user can choose an exercise option through the control panel 145. The CPU calculates the appropriate level of resistance, transmitting rotational orders to the adjustment mechanism 35. The adjustment mechanism then rotates the flexure resistance spine 30. The display 146 can depict all relevant information, including the level of resistance, current exercise status, time elapsed and the state of rotation of the flexure resistance spine.

We claim:

1. An exercise panel, comprising:

a resilient panel having an original orientation, an elastic resistance, and an elastic memory where the resilient panel bends from the original orientation when a bending force and a compressive load is applied and where the elastic memory allows the resilient panel to substantially return to the original orientation when the bending force is removed, multiple pulleys located at each of the opposing ends of the resilient panel, and arranged so tat the respective pulleys on each end of the resilient panel share the same axis of rotation and are each offset from the plane of the resilient panel, a cable that runs from pulley to pulley in a tackle arrangement where each end of the cable emerges from a pulley at the other end of the resilient panel, so tat when the ends of the cable are pulled, resistance is generated by applying the bending moment and the compressive load to the opposing ends of the resilient panel, and means for adjusting the resistance of the resilient panel.

2. An exercise apparatus comprising:

at least one resilient panel having an original orientation, an elastic resistance, and an elastic memory where the resilient panel bends from the original orientation when a bending force and a compressive load is applied and where the elastic memory allows the resilient panel to substantially return to the original orientation when the bending force is removed, multiple pulleys, and a cable wherein the pulleys are located at each of the opposite ends of the resilient panel and are each offset from the plane of the resilient panel and the cable that runs from pulley to pulley in a tackle arrangement, so that when the ends of the cable are pulled, resistance is generated by applying the bending moment and the compressive load to the opposing ends of the resilient panel, and wherein the resistance of the resilient panel is adjustable.

3. A resistance apparatus for exercise equipment comprising:

a resilient panel, the resilient panel having a bending axis, an original orientation, an elastic resistance, and an elastic memory where the resilient panel bends from the original orientation when a bending force and a compressive load is applied and where the elastic memory allows the resilient panel to substantially return to the original orientation when the bending force is removed, multiple pulleys located at each opposing ends of the resilient panel, and arranged so that the respective pulleys on each end of the resilient panel share the same axis of rotation and are each offset from the plane of the resilient panel, a cable that connects the pulleys in a tackle arrangement where each end of the cable emerges from a pulley at the other end of the resilient panel, so that when the ends of the cable are pulled, resistance is generated by applying the bending moment and the compressive load to the opposing ends of the resilient panel.

4. The resistance apparatus of claim 3 wherein the resistance of the resilient panel transmitted through the cable is substantially constant throughout the range of motion.

5. The resistance apparatus of claim 3 wherein the resilient panel is secured to the resistance apparatus by restraining one end of the resilient panel.

6. The resistance apparatus of claim 3 wherein the resilient panel is secured to the resistance apparatus by constraining each end of the resilient panel to travel in a direction parallel to the plane of the resilient panel.

7. The resistance apparatus of claim 3 wherein the resilient panel is secured to the resistance apparatus byte tension of the cable.

* * * * *